US005945961A

United States Patent [19]

Price et al.

[11] Patent Number: 5,945,961

[45] Date of Patent: Aug. 31, 1999

[54] ANTENNA DISH SYSTEM HAVING CONSTRAINED ROTATIONAL MOVEMENT

[75] Inventors: Russell E. Price, Palm Bay; Raymond J. Gastonguay, Malabar, both of Fla.

[73] Assignee: Harris Corporation, Palm Bay, Fla.

[21] Appl. No.: 09/034,703

[22] Filed: Mar. 4, 1998

[51] Int. Cl.[6] ..... H01Q 3/08; H01Q 1/12

[52] U.S. Cl. ..... 343/757; 343/882

[58] Field of Search ..... 343/757, 880, 343/881, 882, 883, 765, 912, 766, 763, 837, 884; H01Q 1/12, 3/08

[56] References Cited

U.S. PATENT DOCUMENTS

| | | | |
|---|---|---|---|
| 3,229,941 | 1/1966 | Suliteanu et al. | 343/765 |
| 3,510,877 | 5/1970 | Turriere | 343/763 |
| 3,945,015 | 3/1976 | Gueguen | 343/765 |
| 4,251,819 | 2/1981 | Vickland | 343/882 |
| 4,783,662 | 11/1988 | Wirth, Jr. et al. | 343/757 |
| 4,814,781 | 3/1989 | DeHaven | 343/766 |
| 5,355,145 | 10/1994 | Lucas | 343/882 |
| 5,418,542 | 5/1995 | Sherwood et al. | 343/711 |
| 5,512,913 | 4/1996 | Staney | 343/781 |

FOREIGN PATENT DOCUMENTS 447786 11/1974 Russian Federation ..... H01G 3/02

*Primary Examiner*—Michael C. Wimer
*Assistant Examiner*—James Clinger
*Attorney, Agent, or Firm*—Allen, Dyer, Doppelt, Milbrath & Gilchrist, P.A.

[57] ABSTRACT

An antenna dish system for tracking satellites includes an antenna dish having peripheral edges. A tripod stand has first and second front legs and a rear leg. An apex is formed by the interconnection of the two front legs and the rear leg. A first linear actuator is mounted on the first front leg and has an output shaft connected to a peripheral edge of the antenna dish. A second linear actuator is mounted on the second front leg and has an output shaft connected to a peripheral edge of the antenna dish. A universal joint is positioned at the apex of the tripod stand and mounts the antenna dish to the tripod stand. The universal joint constrains rotation of the antenna dish about the normal axis, but allows pitch and yaw motion of the antenna dish. A controller is connected to the first and second linear actuators for controlling their output shafts and enabling controlled motion of the antenna dish, such as for tracking satellites.

30 Claims, 4 Drawing Sheets

ANTENNA DISH SYSTEM HAVING CONSTRAINED ROTATIONAL MOVEMENT

FIELD OF THE INVENTION

The present invention relates to antenna dish systems, and more particularly, to an antenna dish system having linear actuators for moving the antenna dish, such as for tracking a satellite.

BACKGROUND OF THE INVENTION

Satellite dish antennas are becoming increasingly popular for receiving signals from orbiting satellites. They are commonly used by consumers who receive television signals, and extensively used by the military and commercial firms for advanced telecommunication applications. They can be found in rural areas that are not served by cable television systems, military bases, and large corporate headquarters. They are also used for various recreational vehicles, such as motor homes, campers, trailers, and mobile homes.

Antenna dish systems vary in their size and can range from having a large antenna dish that is many meters wide to small, portable antenna dishes that are about one meter wide. Some of the antenna dish systems are also portable and can be collapsible to aid in mobility. These more mobile antenna dish systems can be especially adapted for use by the military, commercial news broadcasters and other commercial firms.

Typically, the antenna dish has a parabolic shape and uses heavy and sturdy mounting systems to prevent damage to the antenna dish and associated controls during wind storms. The parabolic geometry allows reflection and collection of signals at a particular point in space at a distance from the inner surface of the antenna.

Some of the antenna dish systems used for satellite communication systems have linear actuators that drive the antenna dish to track a satellite. Typically, a linear actuator has a line of action from its output shaft that is located a distance from the antenna axis rotation to provide a moment arm. Sometimes the linear actuator provides one suspension point for the antenna dish, while other suspension points might include ball joints or similar suspension joints. An example of various types of antenna dish mounting systems and drive mechanisms are disclosed in U.S. Pat. Nos. 4,251,819 to Bickland; 4,783,662 to Wirth, Jr., et al.; 4,814,781 to DeHaven; 5,355,145 to Lucas; 5,418,542 to Sherwood, et al.; and 5,512,913 to Staney.

The '819 patent to Bickland overcomes some of the prior problems in bulky pointing and tracking mechanisms by having three suspension points on the antenna, each suspension joint having two degrees of freedom of movement. This system does not use linear actuators, whose line of action is located a distance from the antenna axis of rotation. A top suspension point includes a ball joint that provides for rotational movement, but constrains movement in all other directions. Other linear supports, which can be vertically moveable, also provide for two degrees of movement, similar to the rotative movement of a ball joint. All suspension points are located toward the medial portion of the antenna dish. Because all suspension points provide for rotational movement, the system includes a stabilizing bar connected between the two vertical legs.

Some applications of antennas require only a low cost, small (one meter), narrow beam (about 1.0 degree) antenna satellite dish that acts as a ground receive terminal (GRS). Such an antenna dish system should be lightweight, have limited antenna dish motion, and be portable. These types of antenna dish systems typically have legs that can be pressed into the ground and then used for portable communications. Additionally, these antenna dish systems are center mounted, full motion pedestals having pointing errors resulting from backlash and compliance. Additionally, the structures are heavy and have a difficult time meeting the necessary pointing accuracy without being heavy and expensive to drive. Other antenna dish approaches used a single axis approach that suffered extreme inconvenience on the operator's part. Some of these expensive and very heavy systems allow a wide range of satellite dish movement.

However, in many portable antenna dish applications, using high frequency, narrow beam antenna dishes, only a limited motion is required for tracking geostationary satellites. Additionally, only very slow antenna dish movement rates are necessary. With these factors in mind, it is not necessary to use these prior art antenna dishes that are complicated, costly, have expensive and sturdy pedestals, and complicated positioning and tracking mechanisms that allow a wide range of antenna dish movement. Those advantages are not necessary for many portable ground receive terminals. Additionally, even some large fixed ground stations do not require large antenna dish movements, but only a limited motion of the antenna dish.

If limited motion and slow rates of antenna dish movement are the only factors necessary, it would be possible to reduce the cost by manufacturing a more simple antenna dish system that is lightweight, inexpensive, and minimizes backlash and compliance in a high wind buffeting while also using lightweight and lower cost small, slow speed linear actuators. However, it will often be necessary to constrain rotational movement in a more simplified system in order not to defeat the control that is being imparted, such as by the use of linear actuators.

SUMMARY OF THE INVENTION

It is therefore an object of the present invention to provide an antenna dish system having a pedestal structure that is stable, strong, and lightweight and that minimizes backlash under high wind buffeting.

It is also an object of the present invention to provide an antenna dish system that can use linear actuators that can be lightweight and low cost for supporting the antenna dish.

It is still another object of the present invention to provide an antenna dish system that constrains the rotation of the antenna dish about the normal axis of rotation.

An antenna dish system of the present invention now allows tracking of satellites while allowing a simple three-point pedestal structure that is stable, strong and lightweight. The system provides three attachment points for the antenna dish. A high stiffness is easily attained and at least two dish attachment points at the edges minimizes backlash under high wind buffeting. Also, the present invention uses linear actuators that can be lightweight and low cost. This simple design includes structure that constrains rotation of the antenna dish about the normal axis of rotation, while allowing attachment points of linear actuator output shafts for the peripheral edge of the satellite dish.

In accordance with the present invention, the antenna dish system for tracking satellites includes an antenna dish having peripheral edges. A tripod stand has first and second front legs and a rear leg. A apex is formed by the interconnection of the two front legs and rear legs. A first linear actuator is mounted on the first front leg and has an output shaft connected to a peripheral edge of the antenna dish. A second linear actuator is mounted on the second front leg and also has an output shaft connected to the peripheral edge of the antenna dish.

Mounting means is positioned at the apex of the tripod stand for mounting the antenna dish to the tripod stand. Rotational constrainment means constrains rotation of the antenna dish about the normal axis. In one aspect of the present invention, the rotational constrainment means comprises a universal joint that allows pitch and yaw motion, but constrains rotation of the satellite dish about the normal axis of rotation. In still another aspect of the present invention, mounting means comprises a ball joint and rotational constrainment means comprises a sway bar having one end connected to one of first and second front legs, and the opposing end connected to the antenna dish.

The universal joint for the ball joint can be connected to the outer perimeter or to the central portion of the antenna dish. Control means is connected to first and second linear actuators for controlling the output shaft of the linear actuators and enabling controlled motion of the antenna dish, such as for tracking satellites. The control means includes a microprocessor and other associated circuitry, which is programmed for tracking the desired satellite. Means mounts each of the first and second linear actuators on respective first and second front legs for allowing adjustive movement of the linear actuators on respective front legs. Such mounting means typically can include a ball joint mechanism. The rear leg further comprises extension means for extending the length of the rear leg. In one aspect of the present invention, the extension means comprises a first tube and a second tube received within the first tube and extendable therefrom. A locking means can lock the second tube a predetermined extended distance out of the first tube.

The first and second front legs are fixed together at the apex and define a predetermined angle between the legs. Pivot means can mount the first and second front legs together at the apex for allowing pivoting motion of the first and second front legs together in a collapsed position for enhancing portability. Pivotable mounting means can mount the rear leg at the apex of the tripod stand for allowing pivotable movement of the rear leg into a range of locked positions. The pivotable mounting means further comprises a semicircular mounting bracket and locking means for locking the rear leg at a desired, angled position within the mounting bracket.

In still another aspect of the present invention, support members can be pivotally mounted to first and second front legs to form a structure that allows antenna dish movement for satellite tracking with constrained, rotational movement. In this aspect of the present invention, the antenna dish system includes an antenna dish and a tripod stand having first and second front legs and a rear leg. An apex is formed by the interconnection of the two front legs and the rear leg. A first support member is pivotally mounted to the first front leg. The first support member extends from the first front leg to the second front leg. A second support member is pivotally mounted to the first support member. The second support member extends from over the second front leg over the first support member and to the first front leg.

An antenna dish is mounted to the second support member. A first linear actuator is mounted on the first front leg and has an output shaft connected to the second support member. A second linear actuator is mounted on the second front leg and has an output shaft connected to the first support member. Thus, movement of the linear actuator output shafts provides controlled antenna dish movement for satellite tracking with constrained rotational movement. The two support members form a two-door approach for pivotal movement of the support members while allowing for movement of the antenna dish. Control means can be connected to first and second linear actuators for controlling movement of the output shafts and enabling motion of the antenna dish, such as for tracking satellites.

The pedestal of the present invention comprises a tripod stand with first and second front legs and a rear leg. An apex is formed by the interconnection of the two front legs and rear legs. First and second linear actuators are mounted to respective first and second front legs, and a universal joint is mounted at the apex of the tripod stand. This unit can be sold as a separate unit, and a desired antenna dish attached to the universal joint or other constrainment means, as well as the output shaft of the linear actuators.

In a method aspect of the present invention, the method of operating an antenna dish system includes the basic structure of an antenna dish; a tripod stand having first and second front legs and a rear leg; and a universal joint positioned at the apex on the tripod, which mounts the antenna dish to the tripod stand. The method comprises the steps of moving the antenna dish while constraining its rotational movement by actuating respective first and second linear actuators that are mounted to respective first and second front legs and peripheral edges of the antenna dish.

DETAILED DESCRIPTION OF THE DRAWINGS

Other objects, features and advantages of the present invention will become apparent from the detailed description of the invention which follows, when considered in light of the accompanying drawings in which.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
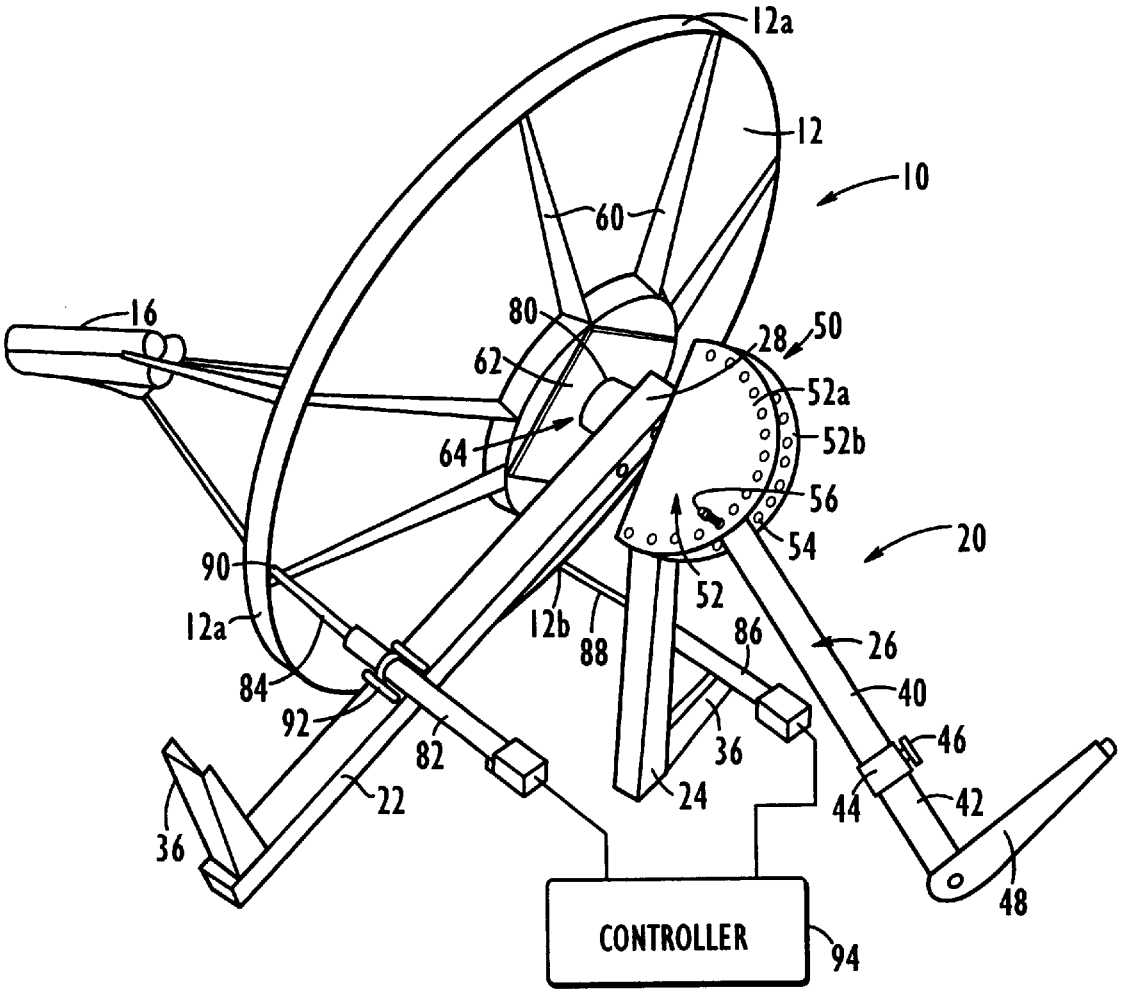
FIG. 1 is an environmental perspective view of the antenna dish system of the present invention, showing a tripod stand, first and second linear actuators and an antenna dish.

Referring now to FIG. 1, there is illustrated generally at 10 a general environmental perspective view of the antenna dish system of the present invention, which is used for tracking satellites. The antenna dish system 10 provides a ground receive terminal (GRT) that uses an extremely low cost, about one meter, narrow beam (about 1.0 degree) antenna dish 12 with a support pedestal that is lightweight and provides limited antenna dish motion such as used with many satellite tracking applications. The antenna dish 12 is a typical parabolic type of antenna dish that can be formed of a lightweight material, such as fiberglass or aluminum, and includes the standard feed horn 16 with a focal length that is chosen for the respective desired communication. The diameter of the dish is typically about one meter, but can vary depending on the type of desired communication. The diameter of the antenna dish 12 and the size of the feed horn 16 is set by the range of frequencies that the antenna dish 12 must receive and transmit. Communication signals are coupled to and from the antenna dish 12 by the conventional means known to those skilled in the art, including a standard wave guide or other transmission means (not shown).

Figure 1A:
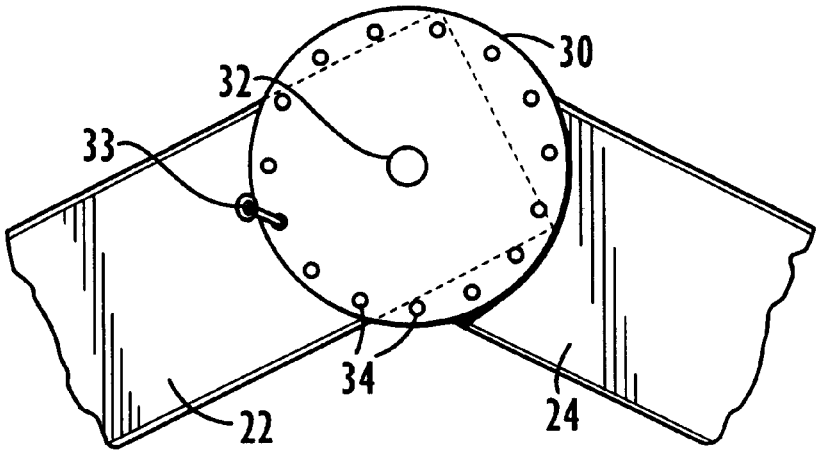
FIG. 1A is an enlarged view of the pivotal connection between first and second front legs.
Figure 2:
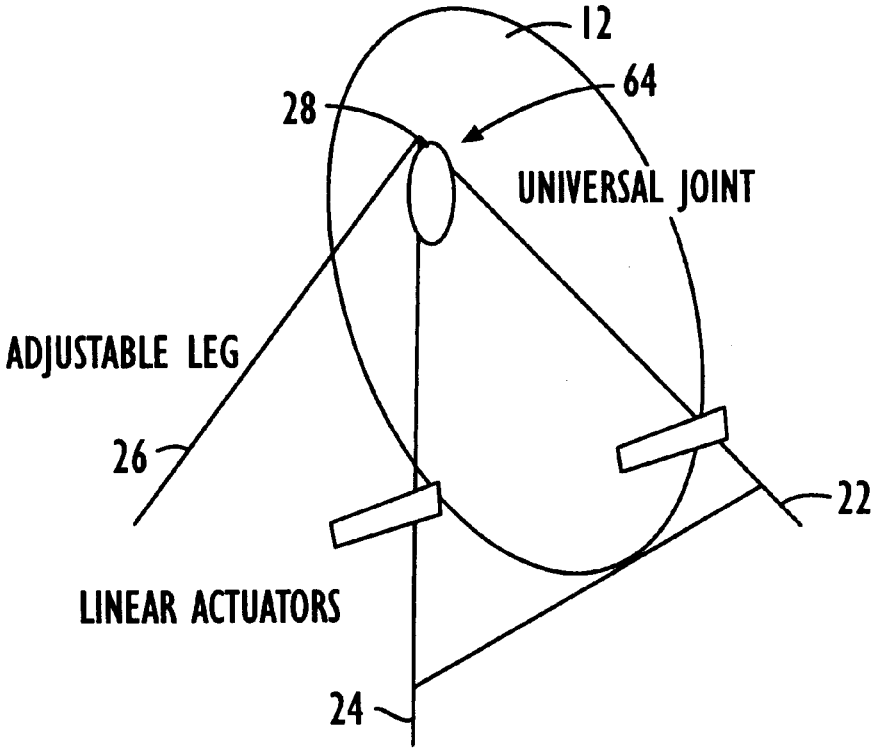
FIG. 2 is a schematic diagram showing a basic layout of the antenna dish, universal joint and linear actuator.

In accordance with the present invention, a support pedestal, indicated generally at 20, provides limited antenna dish motion, and is used for supporting the antenna dish and is formed as a tripod stand having respective first and second front legs 22, 24 and a rear leg 26. An apex 28 is formed by the interconnection of the two front legs 22, 24 and the rear leg 26. As shown in FIG. 1A, the first and second front legs 22, 24 can be pivotally attached to each other to allow collapsability of the first and second front legs, thus aiding in portability of the pedestal. One of the legs, such as the second front leg 24, can include a circular configured, bifurcated flanged end 30 that receives within the flange the first front leg member. A pivot pin 32 provides for pivotal movement of first and second front legs 22, 24 relative to each other. The legs are adjustable in angle by pins 33 and holes 34.

The first and second front legs 22,24 are formed as rectangular configured support members, each having an upstanding channel member 36 that provides stability and can be used for support, such as when the legs are inserted in soft ground, such as sand. The rear leg 26 is tubular configured, and includes a first tube and a second tube 42 received within the first tube 40 and extendable therefrom. A locking collar 44 is mounted on the first tube 40 and includes a locking mechanism, such as a screw 46, that locks the second tube a predetermined extended distance out of the first tube. The end of the second tube also includes an upright channel member 48 that also provides stability, as when the rear leg is set in soft ground, such as sand.

Pivotable mounting means 50 mounts the rear leg 26 at the apex 28 of the tripod stand 20 for allowing pivotable movement of the rear leg into a range of locked positions. The pivotable mounting means is illustrated as a semicircular mounting bracket 52 that mounts to first and second front legs. The rear leg 26 extends between two semicircular bracket members 52*a*, 52*b*, which include alignment holes 54 for receiving a pin 56 that extends not only through the alignment holes 54, but also through an alignment hole (not shown) formed in the first tube 40 of the rear leg 26. Thus, the angle of elevation of the rear leg 26 relative to the front legs 22,24 can be moved over a wide range of angles, up to 180°. Naturally, the first and second front legs, as well as the rear leg, can be formed from lightweight material such as aluminum or reinforced plastic aiding in portability.

The rear of the antenna dish includes support ribs 60 and a mounting plate 62. Mounting means 64 is positioned at the apex 28 of the tripod stand 20 and mounts the antenna dish 12 to the tripod stand. In one preferred aspect of the present invention, the mounting means comprises a universal joint 66 (FIG. 3) positioned at the apex 28 of the tripod stand 20. The universal joint 66 constrains rotation of the antenna dish 12 about the normal axis and allows pitch and yaw motion of the antenna dish.

Figure 3:
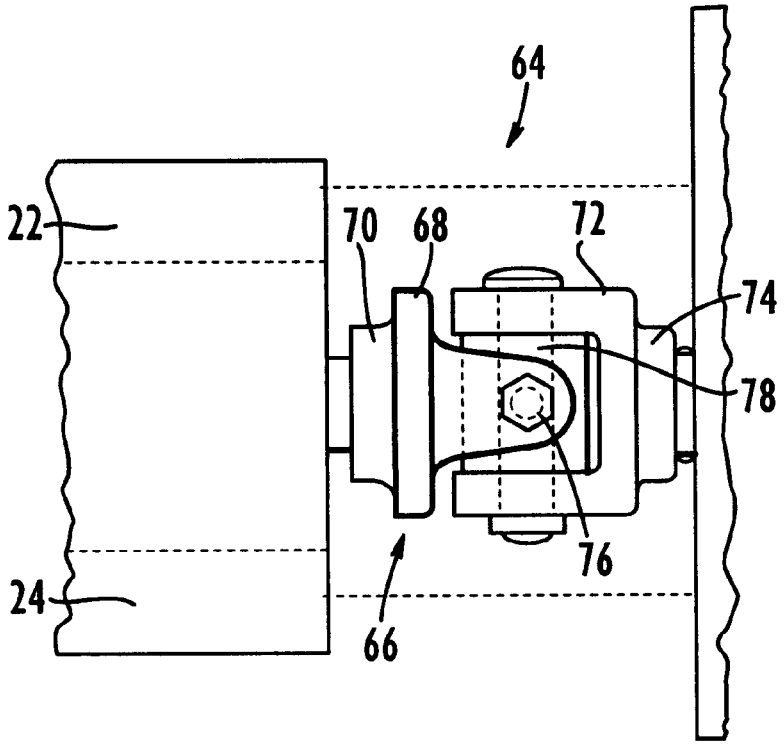
FIG. 3 is a schematic diagram of the interconnection of the universal joint and the satellite dish and tripod stand.
Figure 4:
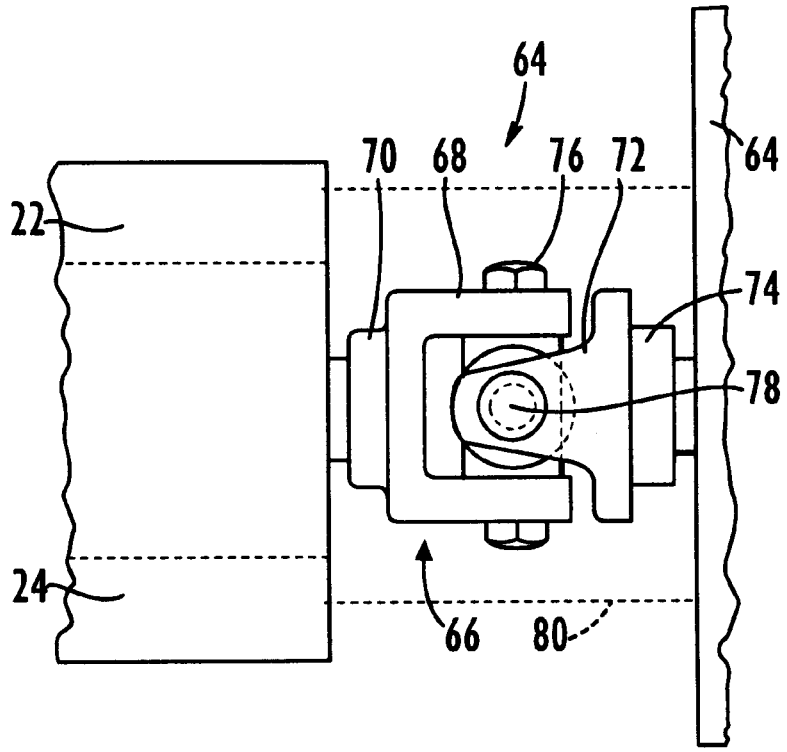
FIG. 4 is another schematic diagram of the universal joint of FIG. 3.

As shown in FIGS. 3 and 4, the universal joint 66 is a standard type of universal joint, such as known to those skilled in the art, and includes a first fork member 68 with a base 70 that is fixed at the apex 28 formed by first and second front legs 22, 24. A second forked member 72 is positioned at 90° to the first fork member and also includes a base 74 that is fixed to the mounting plate 62 on the rear of the antenna dish. Respective first and second center pins 76, 78 extend through respective first and second fork members 68, 72 and intersect each other at their medial portion, as is standard with most universal joints. Because the bases 70, 74 are fixed to the respective mounting plate 62 and apex 28 formed by first and second front legs 22, 24, it is evident that rotational movement of the antenna dish is constrained, but pitch and yaw motion are provided. The universal joint 66 can be contained within a dust enclosure cover 80, as shown in FIG. 1, to protect the universal joint against adverse weather conditions.

As illustrated, a first linear actuator 82 is mounted on the first front leg 22 and has an output shaft 84 connected to the peripheral edge 12*a* of the antenna dish. A second linear actuator 86 is mounted on the second front leg 24 and has an output shaft 88 connected to the peripheral edge 12*b* of the antenna dish 12 opposite the first linear actuator. Each output shaft can be connected to the antenna dish by an appropriate swivel joint mechanism 90 so that antenna movement is provided relative to the output shaft without placing undue stresses on the joint.

The linear actuators 82, 86 can each be mounted by appropriate ball joint mechanisms 92 on each of the respective first and second front legs 22, 24. The linear actuators 82, 86 can be adjusted in position relative to the first and second front legs. Control means 94 in the form of a controller, such as a small personal computer or other processing circuitry, is connected to first and second linear actuators 82, 86 and controls their output shafts and enables motion of the antenna dish 12, such as for tracking satellites. The controller 94 can be preprogrammed, depending on the end use of the antenna dish system, such as its range of operation, frequencies, and physical location.

In operation, the antenna dish system is set up with the first and second front legs 22,24 pivoted outward and locked in their respective desired position. The rear leg 26 is then pivoted to its desired position and locked by means of the locking pin. To enable stability in an environment where the dirt is loose, such as a sandy desert, the legs can be inserted within the sand or other soft earth, where the channel members provide additional stability.

The antenna dish 12 is then programmed and pointed to provide the communication with the desired satellite. As a satellite moves, the respective linear actuator output shafts 84, 88 are extended and retracted as programmed by the controller 94 so that the antenna dish 12 moves as necessary for satellite tracking. The universal joint 66 will constrain the antenna dish 12 from rotating about the axis of the dish. It is evident that the two linear actuators 82, 86 do not restrain the antenna dish from moving in rotation about the axis . However, it is necessary to constrain the rotation about this axis. To allow rotation about that axis would cause the pointing axis of the antenna dish to change, thus defeating any control that would be exercised by the linear actuators.

It is evident, then, that the present invention provides not only the necessary tracking control for satellite communications, but also provides a means for constraining rotational movement. These features are used in an antenna dish system that is lightweight, inexpensive and portable.

Figure 5:
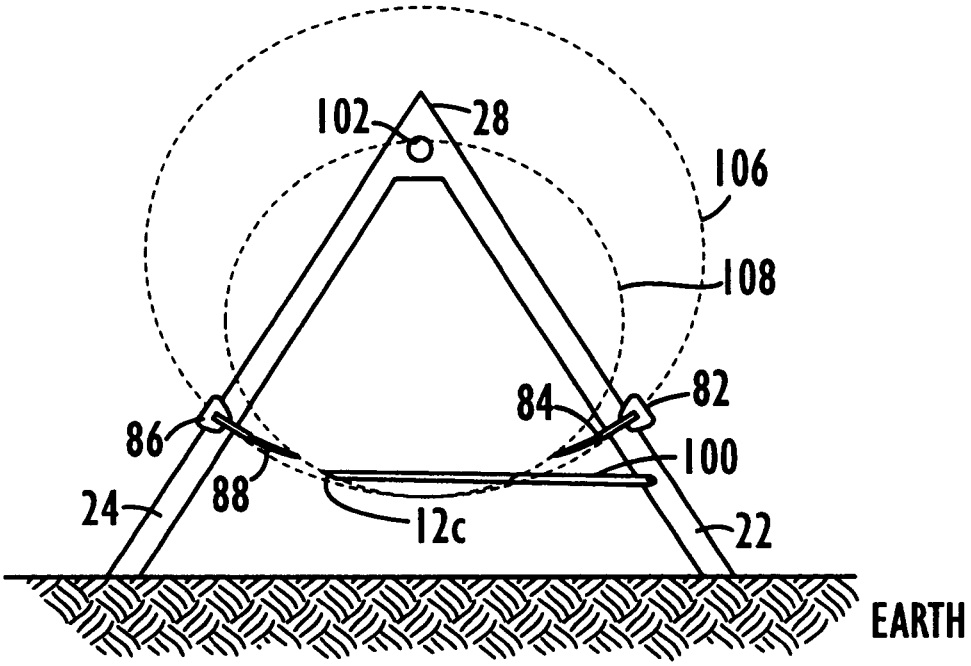
FIG. 5 is a schematic front elevation view of the tripod stand showing a ball joint providing one suspension joint, and a sway bar that is tied to the frame and antenna dish.

FIG. 5 illustrates a second embodiment of the present invention where a sway bar 100 is tied to the antenna dish 12 and the frame formed by the pedestal, i.e., the tripod stand 20. The tripod stand 20 can be anchored to the earth, and, as illustrated schematically in FIG. 5, a ball joint 102 mounts the antenna dish 12 to the apex 28 formed by first and second front legs 22, 24. The ball joint 102 allows rotation, but constrains other movement. It also supports the antenna dish 12 at the apex 28 of the tripod stand 20. As illustrated, the sway bar 100 extends from the second front leg member 24 and is tied at its opposite end to the antenna dish peripheral edge 12*c* to prevent load rotation about the top ball joint 102. The linear actuators in this embodiment typically are mounted on ball joints 104 to prevent over-constraint. In this particular embodiment, the ball joint can mount near the center, as illustrated by the larger dotted line 106, or near the periphery, as indicated by the smaller dotted line 108. Mounting at the periphery adds support during high winds.

Figure 6:
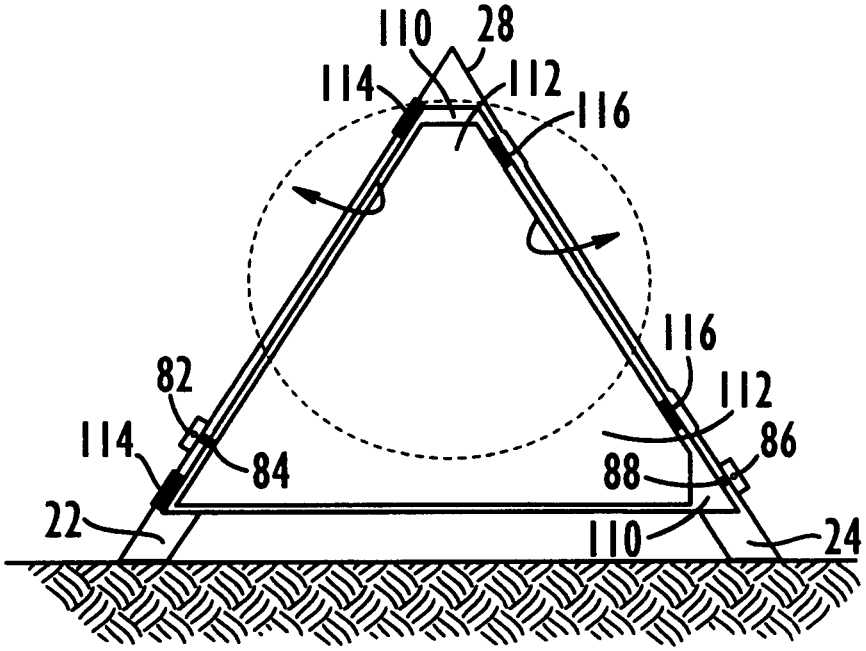
FIG. 6 is a schematic front elevation view of the tripod stand showing the two hinged support members that are pivotally mounted to the respective first and second legs.

FIG. 6 illustrates another embodiment of the present invention having a "two-door" arrangement using first and second triangular configured support members 110,112 that are triangular configured in a similar configuration of first and second front legs when in an operational condition. As illustrated, the first support member 110 is pivotally mounted by a hinge mechanism 114 to the first front leg 22 and extends across to the second front leg 24. The second support member 112 is pivotally mounted on the first support member by appropriate hinge mechanism 116 and extends across to the first front leg member 22. Thus, it is evident that both first and second support members 110,112 are free to pivot outward, with the first support member acting as an intermediate member. The first linear actuator 82 is mounted on the first front leg 22 and has an output shaft 84 connected to the second support member 112. A second linear actuator 86 is mounted on the second front leg member and has its output shaft 88 connected to the first support member 110. As illustrated, the connection points of the output shafts are at the lower portion of the base formed by the triangular configured support members. The antenna dish is mounted on the second support member 112.

In operation, the output shafts 84,88 of the linear actuators 82,86 are actuated and move the respective support members. Rotation of the antenna about its normal axis is constrained by the particular design of the support members, but movement of the antenna dish is still provided for to enable satellite tracking. The controller 94 is appropriately programmed to allow movement of the support members and provide tracking.

It is evident that the present invention as described in all embodiments above is advantageous over the many prior art antenna dish systems because the system can be formed as a lightweight, portable unit and can be inexpensive to manufacture. The simple linear actuators with the universal joint and other rotation constrainment mechanisms allows the use of two linear actuators that can be easily supported on first and second front legs of a tripod stand. The suspension points provided by the output shafts on the peripheral edge of the antenna dish impart greater stability to the system, especially in adverse climate conditions, such as high wind conditions.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that the modifications and embodiments are intended to be included within the scope of the dependent claims.

That which is claimed is:

1. An antenna dish system for tracking satellites comprising:

an antenna dish having peripheral edges and a central portion;

first and second front legs pivotally connected to each other to allow the first and second front legs to be pivotally moved into a collapsed position and outwardly to a predetermined angle and an apex formed by the pivotal interconnection of the two front legs;

a mounting bracket supported by at least one of said first and second front legs at the apex;

a rear leg pivotally mounted to said mounting bracket to adjust angle of elevation of the rear leg relative to the first and second front legs;

a first linear actuator mounted on the first front leg and having an output shaft connected to a peripheral edge of the antenna dish;

a second linear actuator mounted on the second front leg and having an output shaft connected to a peripheral edge of the antenna dish; and a universal joint positioned at the apex of said first and second front legs and mounting the central portion of said antenna dish, wherein said universal joint constrains rotation of said antenna dish about the normal axis and allows pitch and yaw motion of said antenna dish.

2. An antenna dish system according to claim 1, and further comprising control means connected to said first and second linear actuators for controlling the output shaft of said linear actuators and enabling controlled motion of said antenna dish such as for tracking satellites.

3. An antenna dish system according to claim 1, and further comprising means mounting each of said first and second linear actuators on respective first and second front legs for allowing adjustive movement of the linear actuators on respective front legs.

4. An antenna dish system according to claim 1, wherein said rear leg further comprises extension means for extending the length of said rear leg.

5. An antenna dish system according to claim 4, wherein said extension means comprises a first tube, and a second tube received within said first tube and extendible therefrom, and locking means for locking the second tube a predetermined extended distance out of the first tube.

6. An antenna dish system according to claim 1, wherein said mounting bracket and locking means for locking said rear leg in a desired pivoted position within said mounting bracket further comprises a semicircular mounting bracket and a pin extending into said mounting bracket and through said rear leg.

7. An antenna dish system for tracking satellites comprising:

an antenna dish having peripheral edges;

first and second front legs pivotally connected to each other to allow the first and second front legs to be pivotally moved into a collapsed position, and outwardly to a predetermined angle, and an apex formed by the interconnection of the two front legs;

a mounting bracket supported by at least one of said first and second front legs at the apex;

a rear leg pivotally mounted to said mounting bracket to adjust angle of elevation of the rear leg relative to the first and second front legs;

a first linear actuator slidably mounted on the first front leg to allow adjustment in position relative to the first front leg, and having an output shaft connected for swivel movement to a peripheral edge of the antenna dish;

a second linear actuator slidably mounted on the second front leg to allow adjustment in position relative to the second front leg and having an output shaft connected for swivel movement to a peripheral edge of the antenna dish; and mounting means positioned at the apex of the first and second front legs for mounting said antenna dish to said first and second front legs, and including rotational constrainment means for constraining rotation of said antenna dish about the normal axis.

8. An antenna dish system according to claim 7, wherein said rotational constrainment means comprises a universal joint that allows pitch and yaw motion and constrains rotation of said satellite dish about the normal axis.

9. An antenna dish system according to claim 7, wherein said mounting means comprises a ball joint.

10. An antenna dish system according to claim 9, wherein said rotational constrainment means comprises a sway bar having one end connected to one of first or second front legs, and an opposing end connected to said antenna dish.

11. An antenna dish system according to claim 7, wherein said antenna dish further comprises a central portion, and wherein said mounting means is connected to said central portion of said antenna dish.

12. An antenna dish system according to claim 7, further comprising control means connected to said first and second linear actuators for controlling the output shaft of said linear actuators and enabling motion of said antenna dish such as for tracking satellites.

13. An antenna dish system according to claim 7, wherein said rear leg further comprises extension means for extending the length of said rear leg.

14. An antenna dish system according to claim 13, wherein said extension means comprises a first tube, and a second tube received within said first tube and extendible therefrom, and locking means for locking the second tube a predetermined extended distance out of the first tube.

15. An antenna dish system according to claim 7, wherein said mounting bracket and locking means for locking said rear leg in a desired position within said mounting bracket further comprises a semicircular mounting bracket and a pin extending into said mounting bracket.

16. An antenna dish system for tracking satellites comprising:

an antenna dish;

a tripod stand having first and second front legs and a rear leg, and an apex formed by the interconnection of the two front legs and rear leg;

a first support member pivotally mounted to said first front leg, said first support member extending from said first front leg to said second front leg;

a second support member pivotally mounted to said first support member, said second support member extending from said first support member over said first support member to said first front leg;

an antenna dish mounted to said second support member;

a first linear actuator mounted on the first front leg and having an output shaft connected to said second support member; and a second linear actuator mounted on the second front leg and having an output shaft connected to said first support member, wherein movement of said actuator output shafts allows antenna dish movement for satellite tracking with constrained rotational movement.

17. An antenna dish system according to claim 16, further comprising control means connected to said first and second linear actuators for controlling movement output shaft and enabling motion of said antenna dish such as for tracking satellites.

18. An antenna dish system according to claim 16, further comprising means mounting each of first and second linear actuators on respective first and second front legs for allowing adjustive movement of the linear actuators on respective front legs.

19. An antenna dish system according to claim 16, wherein said rear leg further comprises extension means for extending the length of said rear leg.

20. An antenna dish system according to claim 19, wherein said extension means comprises a first tube, and a second tube received within said first tube and extendible therefrom, and locking means for locking the second tube a predetermined extended distance out of the first tube.

21. An antenna dish system according to claim 16, wherein said first and second front legs are fixed together at the apex and define a predetermined angle when an antenna dish is mounted thereto.

22. An antenna dish system according to claim 16, and further comprising pivot means mounting said first and second front legs together at the apex for allowing pivoting of said first and second front legs together in a collapsed position for enhancing portability.

23. An antenna dish system according to claim 16, and further comprising pivotable mounting means mounting said rear leg at the apex of said tripod stand for allowing pivotable movement of said rear leg into a range of locked vertical positions.

24. An antenna dish system according to claim 23, wherein said pivotable mounting means further comprises a semicircular mounting bracket and locking means for locking said rear leg in a desired position within said mounting bracket.

25. A pedestal for supporting an antenna dish comprising:

first and second front legs pivotally connected to each other to allow the first and second front legs to be pivotally moved into a collapsed position, and outwardly to a predetermined angle and an apex formed by the pivotal interconnection of the two front legs;

a mounting bracket supported by at least one of said first and second front legs at the apex;

a rear leg pivotally mounted to said mounting bracket to adjust angle of elevation of the rear leg relative to the first and second front legs;

a first linear actuator slidably mounted on the first front leg to allow adjustment in position relative to the first front leg and having an output shaft adapted to be connected to a peripheral edge of an antenna dish, said output shaft having means for swivel connecting to the peripheral edge;

a second linear actuator mounted on the second front leg to allow adjustment in position relative to the first front leg and having an output shaft adapted to be connected to a peripheral edge of an antenna dish, said output shaft having means for swivel connecting to the peripheral edge; and a universal joint mounted to at least one of said first and second legs, and adapted for connecting to an antenna dish; wherein said universal joint constrains rotation of a mounted antenna dish about the normal axis and allows pitch and yaw motion.

26. A pedestal according to claim 25, further comprising control means connected to said first and second linear actuators for controlling the output shafts of said linear actuators and enabling limited motion of a mounted antenna dish such as for tracking satellites.

27. A pedestal according to claim 25, wherein said rear leg further comprises extension means for extending the length of said rear leg.

28. A pedestal according to claim 27, wherein said extension means comprises a first tube, and a second tube received within said first tube and extendible therefrom, and locking means for locking the second tube a predetermined extended distance out of the first tube.

29. A pedestal according to claim 28, and further comprising pivotable mounting means mounting said rear leg at the apex of the tripod stand for allowing pivotable movement of said rear leg into a range of locked positions.

30. A pedestal according to claim 25, wherein said mounting bracket further comprises a semicircular mounting bracket and a pin extending into said mounting bracket and through said leg for locking said rear leg in a desired position within said mounting bracket.

* * * * *